US008457537B2

(12) United States Patent
Shirafuji et al.

(10) Patent No.: US 8,457,537 B2
(45) Date of Patent: Jun. 4, 2013

(54) IMAGE FORMING APPARATUS FOR TRANSFERRING A TONER IMAGE ONTO A RECORDING MATERIAL

(75) Inventors: Yasuhito Shirafuji, Kashiwa (JP); Yasushi Takeuchi, Moriya (JP); Jun Mochizuki, Abiko (JP); Kazukiyo Akashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 166 days.

(21) Appl. No.: 13/010,699

(22) Filed: Jan. 20, 2011

(65) Prior Publication Data

US 2011/0182630 A1 Jul. 28, 2011

(30) Foreign Application Priority Data

Jan. 25, 2010 (JP) ..... 2010-013239

(51) Int. Cl.
*G03G 15/16* (2006.01)

(52) U.S. Cl.
USPC ..... 399/302

(58) Field of Classification Search
USPC ..... 399/302, 308
See application file for complete search history.

(56) References Cited

U.S. PATENT DOCUMENTS

| | | | | |
|---|---|---|---|---|
| 5,995,794 | A * | 11/1999 | Osada et al. | 399/302 |
| 6,078,773 | A * | 6/2000 | Shimojo et al. | 399/302 |
| 6,697,595 | B2 | 2/2004 | Kawagoe | |

FOREIGN PATENT DOCUMENTS

| | | | |
|---|---|---|---|
| JP | 2002-82543 | A | 3/2002 |
| JP | 2004-029054 | A | 1/2004 |
| JP | 2005017368 | A * | 1/2005 |
| JP | 2009-36941 | A | 2/2009 |

OTHER PUBLICATIONS

Computer translation of JP2005-017368A to Somiya, Jan. 2005.*

* cited by examiner

*Primary Examiner* — Quana M Grainger
(74) *Attorney, Agent, or Firm* — Canon U.S.A., Inc. IP Division

(57) ABSTRACT

An outer diameter of a transfer counter roller is made larger than that of a transfer roller to reduce an electrical discharge phenomenon and influence on a toner image.

7 Claims, 4 Drawing Sheets

IMAGE FORMING APPARATUS FOR TRANSFERRING A TONER IMAGE ONTO A RECORDING MATERIAL

BACKGROUND OF THE INVENTION

1. Field of the Invention

The present invention relates to a transfer technique for transferring a toner image formed on an image bearing member onto a recording material using an electrophotographic technique used in a copying machine or a laser beam printer.

2. Description of the Related Art

Conventionally, an image forming apparatus has been used which includes a transfer portion in which a toner image formed on an image bearing member such as a photosensitive drum is transferred onto an intermediate transfer belt in an endless belt shape stretched by a plurality of rollers and then the toner image formed on the intermediate transfer belt is transferred onto a recording material. The transfer portion further includes the following configuration. A separation roller provided on an inner side of the intermediate transfer belt and a transfer counter roller provided on the inner side of the intermediate transfer belt and located on the more upstream than the separation roller in a rotation direction of the intermediate transfer belt are provided on an inside of a transfer belt. Further, a transfer roller is provided which contacts an outside surface of the intermediate transfer belt and presses the separation roller and the transfer counter roller via the intermediate transfer belt. The transfer portion includes an area in which the transfer roller contacts the intermediate transfer belt.

According to the above described configuration, a width of the transfer portion can be increased to allow suppressing an applied voltage and improving an image quality.

Japanese Patent Application Laid-Open No. 2004-029054 discusses a configuration in which an outer diameter of a separation roller is made smaller than that of a transfer roller to improve separation. In the configuration, the separation roller has the same diameter as a transfer counter roller.

If the transfer counter roller has the same outer diameter as the transfer roller or the transfer counter roller is smaller in an outer diameter than the transfer roller, the following problem occurs.

If the transfer counter roller has the same outer diameter as the transfer roller or the transfer counter roller is smaller in the outer diameter than the transfer roller, a gap between the transfer counter roller in front of the transfer portion and a recording material is widened because of curvature. If the gap between the transfer counter roller in front of the transfer portion and the recording material is wide, behavior of a rear end of the recording material being a free end may cause an electrical discharge phenomenon at the gap between the transfer counter roller and the recording material. The electrical discharge phenomenon may affect a toner image on the intermediate transfer belt.

SUMMARY OF THE INVENTION

According to an aspect of the present invention, an apparatus includes a bearing member, a belt in an endless belt shape configured to carry a toner image transferred from the bearing member, a counter roller configured to stretch the belt, a separation roller configured to stretch the belt at a position downstream of the counter roller in a rotation direction of the belt and separate a recording material from the intermediate transfer belt, and a transfer roller configured to press the counter roller and the separation roller via the belt to transfer the toner image on the belt to the recording material between the counter roller and the separation roller, wherein an outer diameter of the separation roller is smaller than an outer diameter of the transfer roller and an outer diameter of the counter roller is larger than the outer diameter of the transfer roller.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A configuration and a operation of an image forming apparatus according to an exemplary embodiment of the present invention are described below with reference to FIG. 1.

Figure 1:
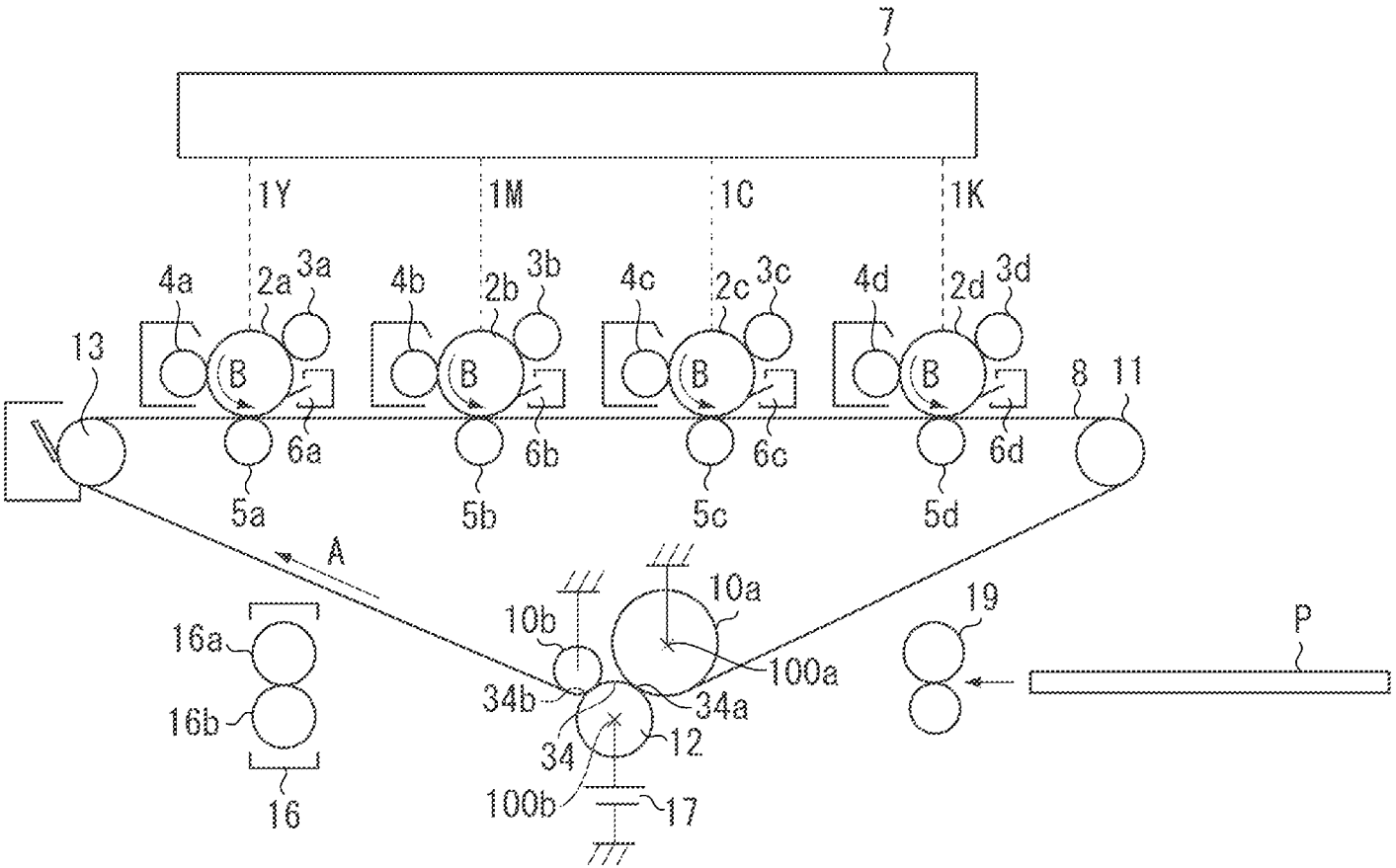
FIG. 1 is a front schematic view of an image forming apparatus according to a first exemplary embodiment of the present invention.

The image forming apparatus illustrated in FIG. 1 is a color image forming apparatus using an electrophotographic system. FIG. 1 is a cross section of the image forming apparatus which is referred to as an intermediate-transfer-tandem type image forming apparatus in which four color image forming units are arranged on an intermediate transfer belt 8.

Image forming units 1Y, 1M, 1C, and 1K are described below. The present exemplary embodiment includes four color image forming units, that are the image forming unit 1Y for forming an image using a yellow toner, the image forming unit 1M for forming an image using a magenta toner, the image forming unit 1C for forming an image using a cyan toner, and the image forming unit 1K for forming an image using a black toner. Each color image forming unit is described. In the present exemplary embodiment, each toner has a negative polarity in a normal frictional charging polarity.

Photosensitive drums 2*a*, 2*b*, 2*c*, and 2*d* as image bearing members are rotatable in a direction indicated by an arrow B. Charging devices 3*a*, 3*b*, 3*c*, and 3*d* charge the photosensitive drums 2*a*, 2*b*, 2*c*, and 2*d* respectively. An exposure device 7 performs image exposure of each photosensitive drum based on input image information. Development devices 4*a*, 4*b*, 4*c*, and 4*d* form toner images on the photosensitive drums 2*a*, 2*b*, 2*c*, and 2*d* respectively. Cleaning devices 6*a*, 6*b*, 6*c*, and 6*d* remove toners remaining on the photosensitive drums 2*a*, 2*b*, 2*c*, and 2*d* respectively after a transfer process.

The toner images formed on the respective photosensitive drums are transferred onto the intermediate transfer belt 8 by primary transfer rollers 5*a*, 5*b*, 5*c*, and 5*d* which form a primary transfer portion in which the toner images are transferred onto the intermediate transfer belt 8. In the above configuration, four color toner images are superimposed on each other, transferred onto the intermediate transfer belt 8, and conveyed to a secondary transfer portion 34.

The intermediate transfer belt 8 in an endless belt shape is stretched by a stretch roller 11, a drive roller 13, a transfer counter roller 10*a*, and a separation roller 10*b* and rotated in a direction indicated by an arrow A. The stretch roller 11 provides tension for the intermediate transfer belt 8 to maintain the tension of the intermediate transfer belt 8 constant. The drive roller 13 transmits a driving force to the intermediate transfer belt 8.

The configuration of the secondary transfer portion 34 which transfers the toner image formed on the intermediate transfer belt 8 onto a recording material P is described below. The transfer counter roller 10*a* and the separation roller 10*b* press a transfer roller 12 via the intermediate transfer belt 8 and form the secondary transfer portion 34 between the transfer counter roller 10*a* and the separation roller 10*b*. The separation roller 10*b* separates the recording material P from the intermediate transfer belt 8. In the present exemplary embodiment, the secondary transfer portion 34 corresponds to a section between a point 34*a* where the transfer counter roller 10*a* starts to press the transfer roller 12 via the intermediate transfer belt 8 and a point 34*b* where the separation roller 10*b* finishes pressing the transfer roller 12 via the intermediate transfer belt 8.

The recording material P conveyed from a sheet cassette is conveyed to the secondary transfer portion 34 by a registration roller pair 19. In the present exemplary embodiment, in the secondary transfer portion 34, an electric current of 100 μA is applied to the transfer roller 12 from a power supply 17 by constant current control to transfer the toner image onto the recording material P. In the present exemplary embodiment, although the constant current control is adopted, constant voltage control may be used.

The toner image formed on the intermediate transfer belt 8 is sent from the registration roller pair 19 to the secondary transfer portion 34 at a preset timing and secondarily transferred onto the recording material P conveyed to the secondary transfer portion 34.

The recording material P onto which the toner image is transferred is conveyed to a fixing device 16. The fixing device 16 includes a fixing roller 16*a* and a pressure roller 16*b*. The fixing roller 16*a* and the pressure roller 16*b* apply a predetermined pressure force and heat to the toner image to melt and fix the toner image on the recording material P, so that an image is formed on the recording material P.

The configuration of the secondary transfer portion 34 which is the characteristic of the present exemplary embodiment is described below.

The secondary transfer portion 34 corresponds to an area of the intermediate transfer belt 8 between an upstream portion 34*a* of the secondary transfer portion, that is a starting point where the transfer counter roller 10*a* starts to press the transfer roller 12 via the intermediate transfer belt 8 and a downstream portion 34*b* of the secondary transfer portion, that is an end point where the separation roller 10*b* finishes pressing the transfer roller 12 via the intermediate transfer belt 8. In other words, in the present exemplary embodiment, the secondary transfer portion 34 is an area where the transfer roller 12 which comes in contact with an outer surface of the intermediate transfer belt 8 contacts the intermediate transfer belt 8.

According to the present invention, for a relationship between an outer diameter of the transfer roller 12 and that of the transfer counter roller 10*a* at the secondary transfer portion 34, the transfer counter roller 10*a* is larger in outer diameter than the transfer roller 12. For the relationship between the outer diameter of the transfer roller 12 and that of the separation roller 10*b*, the separation roller 10*b* is smaller in outer diameter than the transfer roller 12. In the present exemplary embodiment, the transfer counter roller 10*a*, the separation roller 10*b*, and the transfer roller 12 are straight in shape. If a roller which is different in outer diameters between the center and end portions is used, the outer diameter of the center portion of the roller which the recording material P passes is compared irrespective of a size of the recording material P. In the present exemplary embodiment, the recording material P is conveyed along the center of the transfer roller 12.

In the present exemplary embodiment, the transfer roller 12 has a diameter of 20 mm (a 12 mm diameter core and a 4 mm thick ion conductive urethane sponge layer). The transfer counter roller 10*a* with a diameter of 30 mm (a 26 mm diameter core and 2 mm thick ethylene propylene diene monomer (EPDM) rubber layer) and the separation roller 10*b* with a diameter of 16 mm (a 12 mm diameter core and 2 mm EPDM layer) are arranged to face the transfer roller 12.

The EPDM used in the transfer counter roller 10*a* and the separation roller 10*b* is equivalent to each other. Each of the transfer counter roller 10*a* and the separation roller 10*b* has a resistance of $1\times10^4$ to $1\times10^5\Omega$.

Such a configuration is determined in consideration of scattering of thick paper and separation of thin paper at the secondary transfer portion 34 of the image forming apparatus.

The scattering and the separation of thin paper related to the transfer roller 12, the transfer counter roller 10*a*, and the separation roller 10*b* are described below.

The relationship between the transfer roller 12 and the transfer counter roller 10*a* is described in association with the scattering.

The scattering is attributed to a transfer of the toner on the intermediate transfer belt 8 to the recording material because an electric field on the upstream side of the secondary transfer portion 34 becomes greater than an electric field at the secondary transfer portion 34 in a conveyance direction of the recording material P before the recording material P reaches the secondary transfer portion 34. Therefore, the scattering can be prevented from occurring by setting an electric field in the area upstream in the conveyance direction of the recording material P smaller than an electric field in the area of the secondary transfer portion 34.

In the present exemplary embodiment, the outer diameter of the transfer roller 12 is thus made smaller than that of the transfer counter roller 10*a* so that the transfer counter roller 10*a* does not face the transfer roller 12 in the area upstream than the area where the secondary transfer portion 34 is located in the conveyance direction of the recording material P.

In the present exemplary embodiment, the transfer roller 12 and the transfer counter roller 10*a* are arranged so that a center point 100*b* of the transfer roller 12 is positioned more downstream than a center point 100*a* of the transfer counter roller 10*a* in the conveyance direction of the recording material P.

The relationship between the transfer roller 12 and the separation roller 10*b* is described in association with the separation of the recording material P. The greater the outer diameter of the separation roller 10*b* becomes, the smaller the curvature of a separation portion at the rear end of the secondary transfer portion becomes. As a result, the recording material tends to wind around the intermediate transfer belt 8 and the separation is decreased. Thus, if the outer diameter of the separation roller 10*b* is reduced, the curvature of the separation portion can be increased and the separation can be improved.

According to the configuration described above, the scattering of thick paper and the poor separation of thin paper occurred at the secondary transfer portion 34 can be suppressed.

Suppression of the scattering and the poor separation of thin paper relates to hardness of the rollers. The relationship between the suppression of the scattering and the poor separation of thin paper and the hardness of the rollers is described below.

Figure 3:
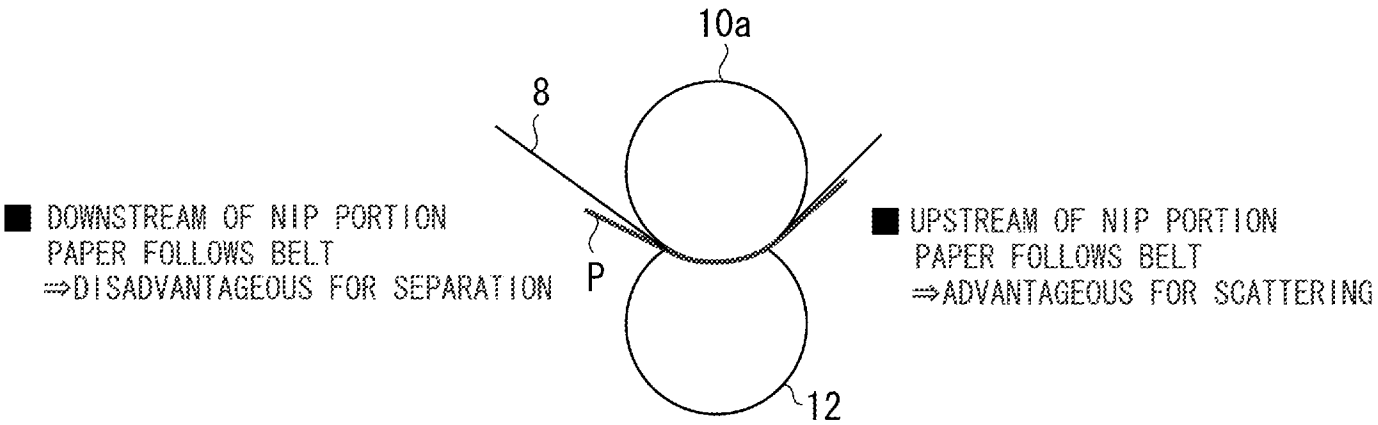
FIG. 3 is an enlarged schematic diagram illustrating a relationship between hardness of a transfer counter roller and conveyance of paper according to the exemplary embodiment of the present invention.

As illustrated in FIG. 3, if the transfer counter roller 10*a* is higher in hardness than the transfer roller 12 via the intermediate transfer belt 8, the transfer counter roller 10*a* bites into the transfer roller 12 via the intermediate transfer belt 8, so that the sandwiched recording material P follows the intermediate transfer belt 8.

Thus, the recording material P is brought into closer contact with the intermediate transfer belt 8 to allow suppressing electric discharge, so that the scattering can be reduced.

Figure 4:
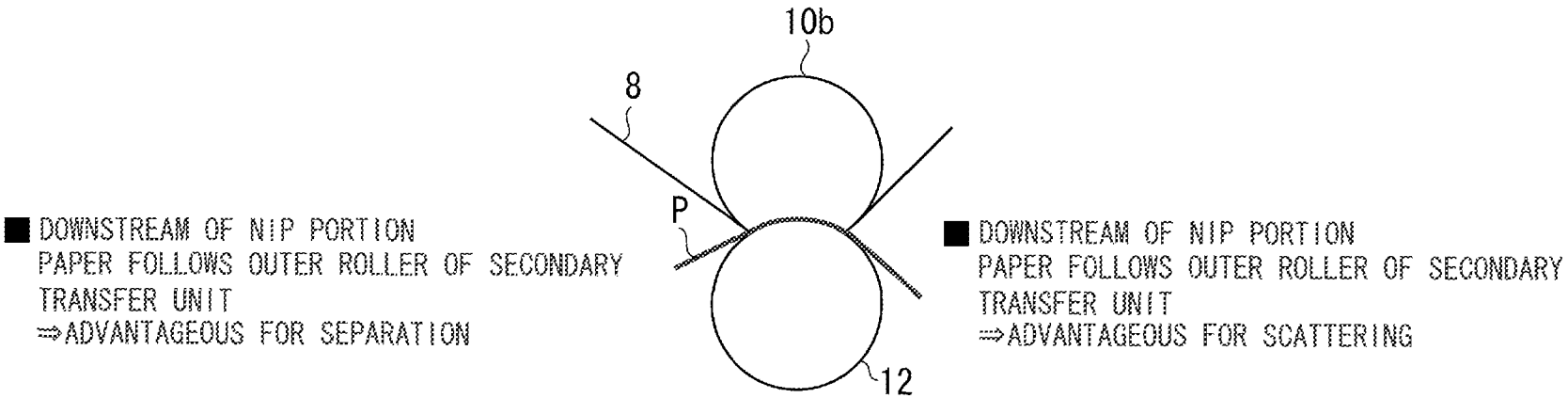
FIG. 4 is an enlarged schematic diagram illustrating a relationship between hardness of a separation roller and conveyance of paper according to the exemplary embodiment of the present invention.

As illustrated in FIG. 4, if the separation roller 10*b* is lower in hardness than the transfer roller 12 via the intermediate transfer belt 8, the transfer roller 12 bites into the separation roller 10*b* via the intermediate transfer belt 8, so that the sandwiched recording material P follows the transfer roller 12.

This configuration can improve the separation of thin paper.

Thus, the transfer counter roller 10*a* is made higher in hardness than the transfer roller 12 in the secondary transfer portion and the transfer roller 12 is made higher in hardness than the separation roller 10*b* in the secondary transfer portion 34*b* to realize suppression of the scattering phenomenon and separation of thin paper.

A configuration and a operation of an image forming apparatus according to a second exemplary embodiment of the present invention are described below with reference to FIG. 2.

Figure 2:
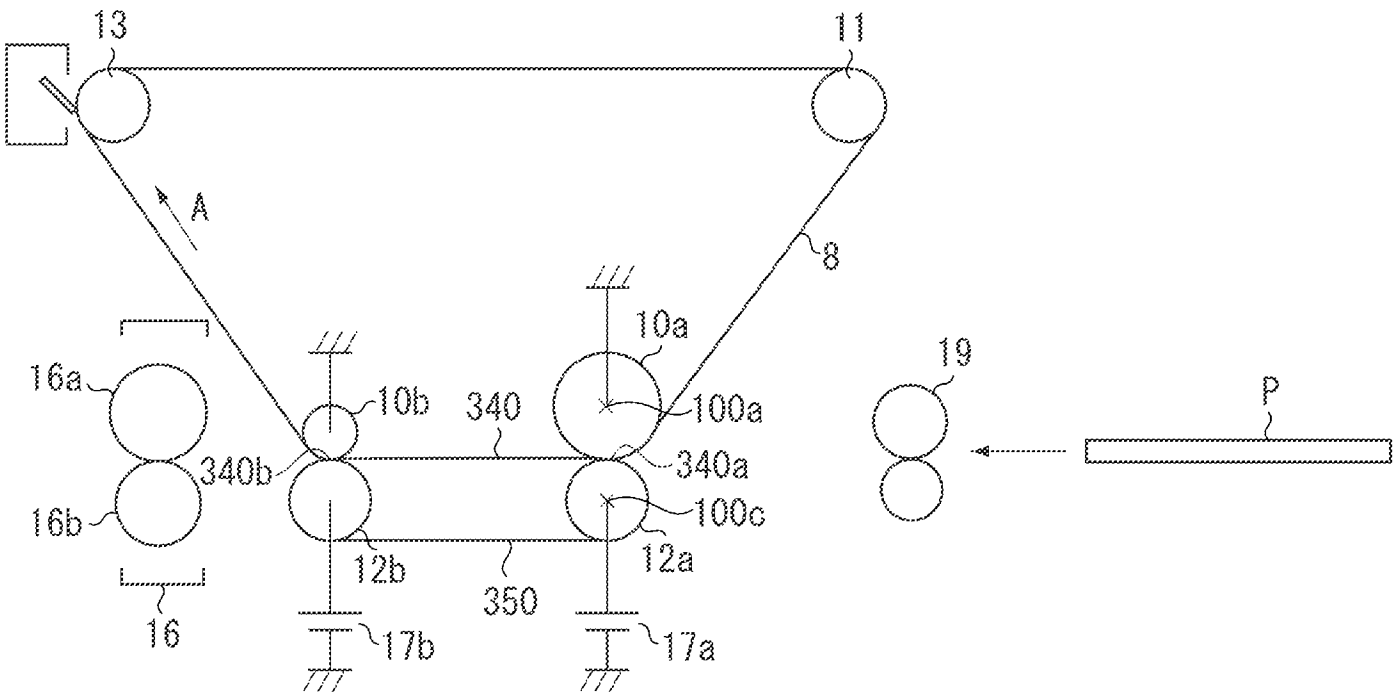
FIG. 2 is a front schematic view of an image forming apparatus according to a second exemplary embodiment of the present invention.

FIG. 2 illustrates the intermediate transfer belt 8 and subsequent process components. The process components for forming the toner image on the intermediate transfer belt 8 are similar to those in the first exemplary embodiment, so that the description thereof is omitted.

The configuration and the operation of a secondary transfer portion 340 different from the one of the first exemplary embodiment are described.

The configuration around the secondary transfer portion 340 is described below.

The secondary transfer portion 340 refers to a nip portion for nipping and conveying a recording material. The secondary transfer portion 340 corresponds to a section where a transfer belt 350 stretched by a first transfer roller 12*a* and a second transfer roller 12*b* is brought into contact with the intermediate transfer belt 8. The first and second transfer rollers 12*a* and 12*b* are similar in configuration to the transfer roller 12 in the first exemplary embodiment.

The intermediate transfer belt 8 in an endless belt shape is stretched by the stretch roller 11, the drive roller 13, the transfer counter roller 10*a*, and the separation roller 10*b* and rotated in the direction indicated by an arrow A. The stretch roller 11 provides tension for the intermediate transfer belt 8 to maintain the tension of the intermediate transfer belt 8 constant. The drive roller 13 transmits a driving force to the intermediate transfer belt 8. The transfer counter roller 10*a* presses the first transfer roller 12*a* via the intermediate transfer belt 8 and the transfer belt 350. The separation roller 10*b* presses the second transfer roller 12*b* via the intermediate transfer belt 8 and the transfer belt 350.

The recording material P conveyed from a sheet cassette is conveyed to the secondary transfer portion 340 by a registration roller pair 19. In the secondary transfer portion 340, an electric current of 100 μA is applied to the first and second transfer rollers 12*a* and 12*b* from power supplies 17*a* and 17*b* by constant current control respectively to transfer the toner image onto the recording material P. The present invention can be implemented by constant voltage control.

In that case, the toner image formed on the intermediate transfer belt 8 is sent from the registration roller pair 19 to the secondary transfer portion 340 at a preset timing and secondarily transferred onto the recording material P conveyed to the secondary transfer portion 340.

Then, the recording material P is conveyed to the fixing device 16. The fixing device 16 includes a fixing roller 16*a* and a pressure roller 16*b*. The fixing roller 16*a* and the pressure roller 16*b* apply a predetermined pressure force and heat to the toner image to melt and fix the toner image on the recording material P, so that an image is formed on the recording material P.

The configuration of the secondary transfer portion 340 which is the characteristic of the present exemplary embodiment is described below.

The secondary transfer portion 340 corresponds to an area of the intermediate transfer belt 8 between an upstream portion 340*a* of the secondary transfer portion, that is a starting point where the transfer counter roller 10*a* starts to press the first transfer roller 12*a* via the intermediate transfer belt 8 and the transfer belt 350 and a downstream portion 340*b* of the secondary transfer portion, that is an end point where the separation roller 10*b* finishes pressing the second transfer roller 12*b* via the intermediate transfer belt 8 and the transfer belt 350.

According to the present invention, for a relationship between an outer diameter of the first transfer roller 12*a* and that of the transfer counter roller 10*a*, the transfer counter roller 10*a* is larger in outer diameter than the first transfer roller 12*a*. For a relationship between the outer diameter of the second transfer roller 12*a* and that of the separation roller 10*b*, the separation roller 10*b* is smaller in outer diameter than the second transfer roller 12*b*. The transfer counter roller 10*a* is larger in outer diameter than the separation roller 10*b*.

In the present exemplary embodiment, the first transfer roller 12*a* has a diameter of 20 mm (a 12 mm diameter core and a 4 mm thick ion conductive urethane sponge layer). The transfer counter roller 10*a* with a diameter of 30 mm (a 26 mm diameter core and 2 mm thick ethylene propylene diene monomer (EPDM) rubber layer) is arranged to face the first transfer roller 12*a*. The separation roller 10*b* with a diameter of 16 mm (a 12 mm diameter core and 2 mm thick EPDM layer) is arranged to face the second transfer roller 12*b* with a diameter of 20 mm (a 12 mm diameter and a 6 mm thick ion conductive urethane sponge layer).

The EPDM used in the transfer counter roller 10*a* and the separation roller 10*b* is equivalent to each other. Each of the transfer counter roller 10*a* and the separation roller 10*b* has a resistance of $1\times10^4$ to $1\times10^5\Omega$.

Such a configuration is determined in consideration of scattering of thick paper and separation of thin paper at the secondary transfer portion 340 of the image forming apparatus.

In the present exemplary embodiment, the following relationship is satisfied for the outer diameter of each roller, the transfer counter roller 10*a*>the first transfer roller 12*a* and the second transfer roller 12*b*>the separation roller 10*b*.

According to the configuration described above, the scattering of thick paper and the poor separation of thin paper occurred at the secondary transfer portion 340 can be suppressed.

In addition, the suppression of the scattering of thick paper and the poor separation of thin paper relates to the hardness of the rollers.

According to the present invention, for the relationship between the transfer counter roller 10*a* and the first transfer roller 12*a*, the transfer counter roller 10*a* is higher in hardness than the first transfer roller 12*a*. For the relationship between the separation roller 10*b* and the second transfer roller 12*b*, the second transfer roller 12*b* is higher in hardness than the separation roller 10*b*.

Further in the present exemplary embodiment, the first transfer roller 12*a* is similar to the second transfer roller 12*b* in hardness. However, even if the first transfer roller 12*a* is different from the second transfer roller 12*b* in hardness, the configuration satisfying the above relationship can suppress the scattering phenomenon and improve the separation of thin paper.

In the present exemplary embodiment, the center point 100*a* of the transfer counter roller 10*a* and the center point 100*c* of the transfer roller 12*a* are arranged substantially at the same position in the conveyance direction of the recording material. However, it is desirable to reduce an electric field between the transfer counter roller 10*a* and the transfer roller 12*a* which are located more upstream than the secondary transfer portion 340 in the conveyance direction of the recording material. Therefore, the center point 100*c* of the transfer roller 12*a* is located more downstream than the center point 100*a* of the transfer counter roller 10*a* in the conveyance direction of the recording material, which is more effective for the scattering phenomenon.

As described above, the exemplary embodiments of the present invention can improve the separation of a recording material which passes through the transfer portion while an influence of behavior of a rear end of the recording material on the toner image on the intermediate transfer belt is being reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-013239 filed Jan. 25, 2010, which is hereby incorporated by reference herein in its entirety.

What is claimed is:

1. An image forming apparatus comprising:

an image bearing member;

an intermediate transfer belt in an endless belt shape configured to carry a toner image transferred from the image bearing member;

a transfer counter roller configured to stretch the intermediate transfer belt;

a separation roller configured to stretch the intermediate transfer belt at a position downstream of the transfer counter roller in a rotation direction of the intermediate transfer belt and separate a recording material from the intermediate transfer belt; and a transfer roller configured to form a transfer portion in an area from a most upstream portion of an area where the transfer counter roller is in contact with the transfer roller across the intermediate transfer belt to a most downstream portion of an area where the separation roller is in contact with the transfer roller across the intermediate transfer belt in a rotation direction of the intermediate transfer belt, and to transfer the toner image on the intermediate transfer belt to the recording material at the transfer portion, wherein an outer diameter of the separation roller is smaller than an outer diameter of the transfer roller and an outer diameter of the transfer counter roller is larger than the outer diameter of the transfer roller.

2. The apparatus according to claim 1, wherein hardness of the transfer counter roller is higher than hardness of the transfer roller.

3. The apparatus according to claim 1, wherein hardness of the separation roller is lower than the hardness of the transfer roller.

4. An image forming apparatus comprising:

an image bearing member;

an intermediate transfer belt in an endless belt shape configured to carry a toner image transferred from the image bearing member;

a transfer counter roller configured to stretch the intermediate transfer belt;

a separation roller configured to stretch the intermediate transfer belt at a position downstream of the transfer counter roller in a rotation direction of the intermediate transfer belt and separate a recording material from the intermediate transfer belt; and a first transfer roller configured to press the transfer counter roller across the intermediate transfer belt at a first transfer nip in a rotation direction of the intermediate transfer belt; and a second transfer roller configured to press the separation roller via the intermediate transfer belt at a second transfer nip;

a first electric field applying member configured to apply a first electric field at the first transfer nip so that the toner image on the intermediate transfer belt is transferred to the recording material;

a second electric field applying member configured to apply a second electric field, having a same direction as the direction of the first electric field, at the second transfer nip so that the toner image on the intermediate transfer belt is transferred to the recording material;

a controller configured to control the first electric field applying member and the second electric field applying member, so that both of the first electric field and the second electric field are applied when the recording material passes through at least an area from the first transfer nip to the second transfer nip, wherein an outer diameter of the separation roller is smaller than an outer diameter of the second transfer roller and an outer diameter of the transfer counter roller is larger than an outer diameter of the first transfer roller.

5. The apparatus according to claim 4, wherein hardness of the transfer counter roller is higher than hardness of the first transfer roller.

6. The apparatus according to claim 4, wherein hardness of the separation roller is lower than hardness of the second transfer roller.

7. The apparatus according to claim 4, wherein the outer diameter of the transfer counter roller is larger than the outer diameter of the separation roller.

* * * * *